US010494844B2

(12) United States Patent
Shick et al.

(10) Patent No.: US 10,494,844 B2
(45) Date of Patent: Dec. 3, 2019

(54) DETENT FOR LIMITING THE MOTION OF A DOOR HINGE

(71) Applicants: John W Shick, Hilton, NY (US); Howard E Vragel, Hilton, NY (US); Michael J Shick, Chandler, AZ (US)

(72) Inventors: John W Shick, Hilton, NY (US); Howard E Vragel, Hilton, NY (US); Michael J Shick, Chandler, AZ (US)

( * ) Notice: Subject to any disclaimer, the term of this patent is extended or adjusted under 35 U.S.C. 154(b) by 416 days.

(21) Appl. No.: 15/365,882

(22) Filed: Nov. 30, 2016

(65) Prior Publication Data

US 2018/0148961 A1 May 31, 2018

(51) Int. Cl.
*E05C 19/18* (2006.01)
*E05B 63/00* (2006.01)

(52) U.S. Cl.
CPC ..... *E05C 19/184* (2013.01); *E05B 63/0008* (2013.01)

(58) Field of Classification Search
CPC ..... Y10T 292/228; Y10T 292/23; Y10T 292/237; Y10T 292/34; Y10T 292/37; Y10T 292/373; Y10T 292/376; Y10T 292/379; Y10T 292/382; Y10T 292/385; Y10T 292/388; Y10T 292/391; Y10T 292/65; Y10T 292/67; Y10T 16/551; Y10T 16/5518; E05C 19/184; E05C 19/00; E05C 19/003; E05C 19/18; E05C 19/188; E05C 17/00; E05C 17/02; E05C 17/025; E05C 17/047; E05C 17/12; E05C 17/14; E05C 17/20; E05C 17/54; E05B 63/0008; E05B 63/0004; E05D 11/1014; E05D 11/1028; E05D 11/105; E05D 11/1078; E05D 11/0027; E05D 11/06; Y10S 292/17; Y10S 292/15; Y10S 292/65; E05F 5/06; E05F 3/20
USPC ..... 49/383; 16/250, 82, 374
See application file for complete search history.

(56) References Cited

U.S. PATENT DOCUMENTS

| | | | | |
|---|---|---|---|---|
| 3,971,100 A * | 7/1976 | Anop | E05C 19/184 16/375 |
| 4,958,868 A * | 9/1990 | Watrous, Jr. | E05C 19/184 292/258 |
| 5,098,142 A * | 3/1992 | Fontenot | E05C 19/184 292/288 |
| 2009/0322106 A1* | 12/2009 | Wood | E05C 19/184 292/288 |
| 2015/0008684 A1* | 1/2015 | Ching | E05C 19/184 292/288 |

* cited by examiner

*Primary Examiner* — Alyson M Merlino

(57) ABSTRACT

A security apparatus that functions as a detent which inhibits the motion of a door hinge. This security apparatus includes a back panel, a stop bracket, and a slotted hole. The back panel is a rigid plate that functions as a bar that inhibits the motion of a door. The back panel has a first panel edge and a second panel edge. The first panel edge and the second panel edge are edged are located at opposite ends of the back panel, forming it's the physical boundaries of the back panel. The stop bracket is a rigid beam that is connected to the first panel edge of the back panel. This enables the stop bracket to limit the distance a door hinge may travel through the slotted hole. The slotted hole is cut into the back panel from the second panel edge to next to the stop bracket.

19 Claims, 7 Drawing Sheets

DETENT FOR LIMITING THE MOTION OF A DOOR HINGE

FIELD OF THE INVENTION

The present invention relates generally to a door security device. More specifically, the present invention relates to a plate that is attached to the hinge of a door and then used to prevent the door from being opened.

BACKGROUND OF THE INVENTION

From the family locking their doors at night, to law enforcement personnel monitoring the cells of convicted criminals, security is a major concern for all humans. As such, humans have developed various types of locking devices that can be used to secure a door. While highly secured facilities make use of reinforced doors and multiple locking devices, standard doors typically employ one or two locks. These locks can often be picked or easily forced open. As a result, unmodified standard doors offer significantly less security to users.

It is an objective of the present invention, detent for limiting the motion of a door hinge, to address the shortcomings of standard doors. The present invention is a rigid device that is placed over the hinge pin housing. Attaching the present invention to the hinge of a door enables the present invention to mechanically prevent the door from being opened. This functionality enables a user to add security to a standard door without making any permanent modifications to the door or doorframe. Furthermore, the present invention is attached to the hinge on the inside of the door. This placement prevents the present invention from being disengaged or removed by an unwanted intruder.

DETAIL DESCRIPTIONS OF THE INVENTION

All illustrations of the drawings are for the purpose of describing selected versions of the present invention and are not intended to limit the scope of the present invention.

Figure 1:
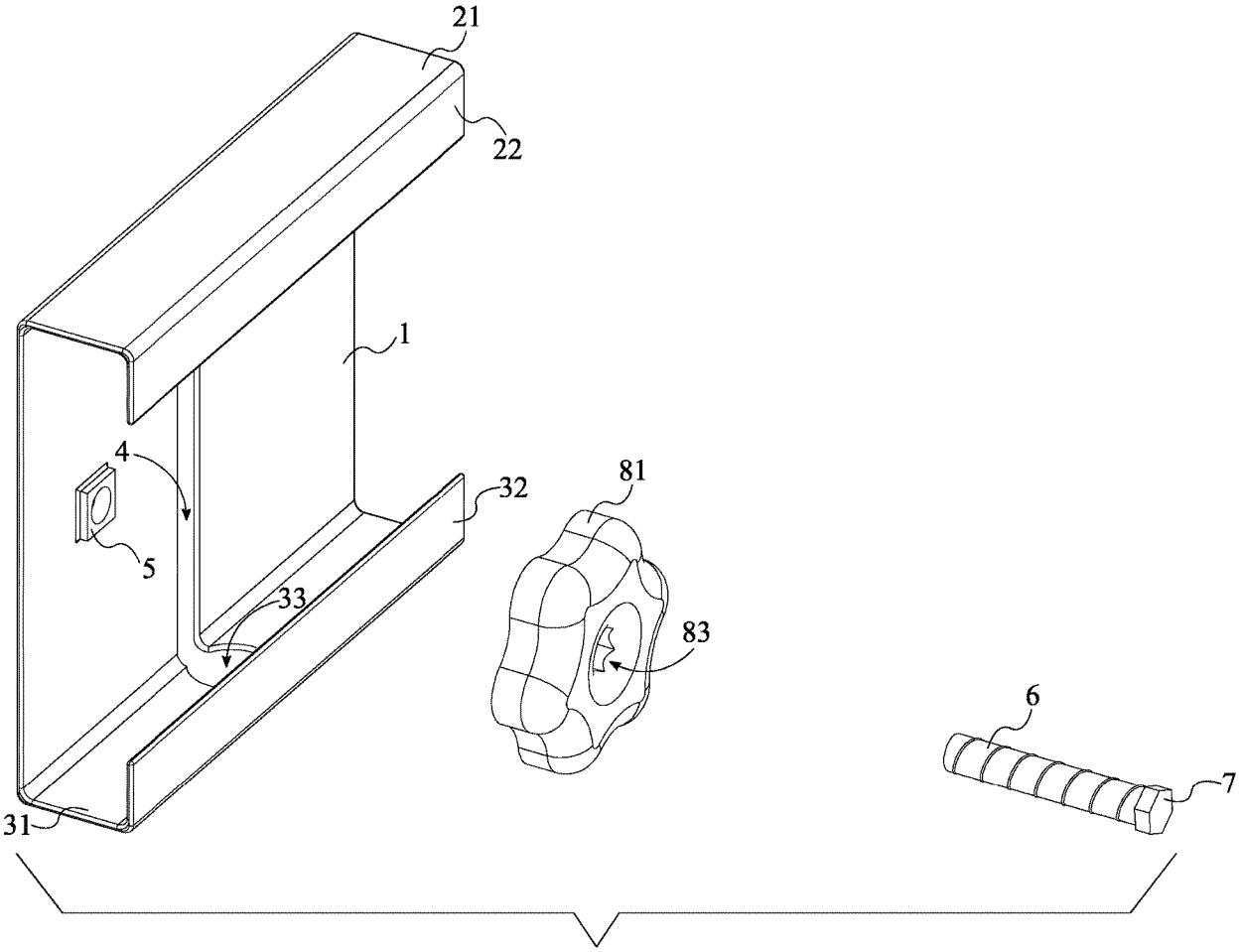
FIG. 1 is an exploded perspective view of the present invention.
Figure 4:
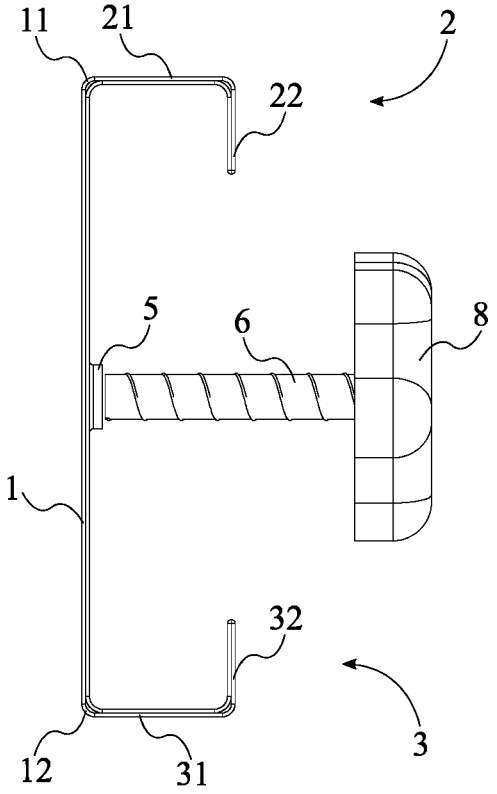
FIG. 4 is a side view of the present invention.

In reference to FIG. 1 and FIG. 4, the present invention is a detent for inhibiting the motion of a door hinge. The present invention is a device that slides over the hinge of a door and prevents the door from being opened. To accomplish this, the present invention comprises a back panel 1, a stop bracket 2, and a slotted hole 4. The back panel 1 is a rigid plate that forms the structural foundation for the present invention. The back panel 1 comprises a first panel edge 11 and a second panel edge 12. The first panel edge 11 and the second panel edge 12 are positioned opposite to each other across the back panel 1. As a result, the first panel edge 11 and the second panel edge 12 of the back panel 1 are clearly established. The first panel edge 11 functions as the connection point for the stop bracket 2. Additionally, the second panel edge 12 forms the starting point for the slotted hole 4. The stop bracket 2 is a rigid beam that increases the structural integrity of the present invention. The stop bracket 2 is adjacently connected along the first panel edge 11. Consequently, the stop bracket 2 forms a rigid boundary for the hinge of a door to which the present invention is attached. The slotted hole 4 is a hole that traverses normal to and through the back panel 1 so that the back panel 1 can be braced against the hinge of a door. The slotted hole 4 traverses into the back panel 1 from the second panel edge 12. Accordingly, the back panel 1 can be slid over the hinge of a door.

Figure 2:
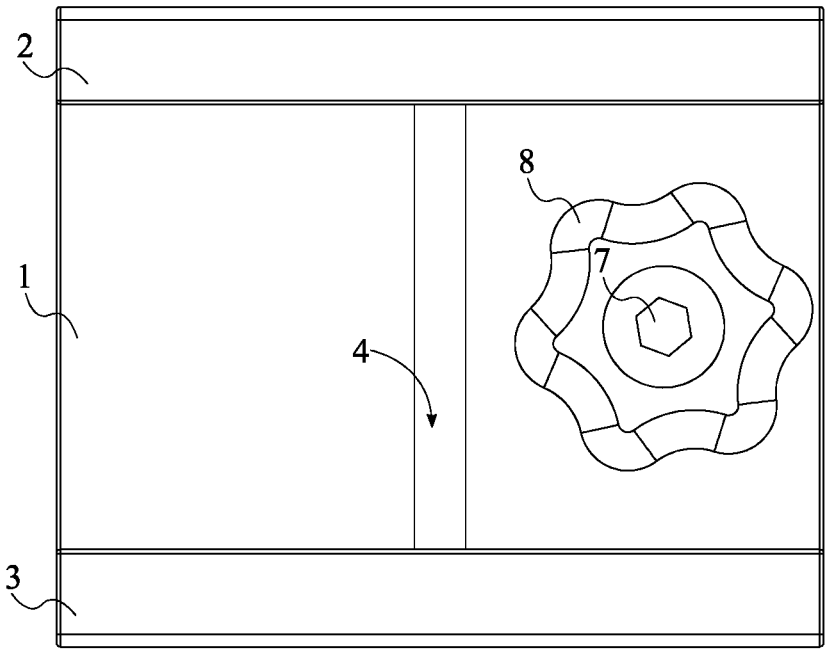
FIG. 2 is a front view of the present invention.

In reference to FIG. 1, FIG. 2, and FIG. 4, the present invention further comprises a keyhole bracket 3 and a keyhole slot 33. The keyhole bracket 3 is a rigid beam that is used to increase the structural integrity of the present invention. The keyhole bracket 3 is adjacently connected along the second panel edge 12 of the back panel 1 so that the back panel 1 is prevented from warping. The keyhole slot 33 traverses through the keyhole bracket 3 into the slotted hole 4. As a result, the hinge of a door can slide through the keyhole slot 33 and into the slotted hole 4.

Referencing FIG. 1 and FIG. 4, in the present invention, the keyhole bracket 3 comprises a keyhole leg 31 and a bracing leg 32. The keyhole leg 31 and the bracing leg 32 are rigid beams that are connected to form an L-shaped keyhole bracket 3. More specifically, the keyhole leg 31 is adjacently and perpendicularly connected to the back panel 1. Consequently, the keyhole leg 31 forms the first leg of the L-shaped keyhole bracket 3 that is connected to the back panel 1. The bracing leg 32 is adjacently and perpendicularly connected to the keyhole leg 31, opposite to the back panel 1. Accordingly, the bracing leg 32 forms the second leg of the keyhole bracket 3 and prevents the back panel 1 from warping due to externally applied forces. The keyhole slot 33 traverses normal to and through the keyhole leg 31 so that the hinge of a door may pass through the keyhole leg 31 and slide into the slotted hole 4.

Referencing FIG. 1 and FIG. 4, in the present invention, the stop bracket 2 further comprises a first leg 21 and a second leg 22. The first leg 21 and the second leg 22 are rigid beams that are connected to form an L-shaped stop bracket 2. The first leg 21 is adjacently and perpendicularly connected to the back panel 1. Consequently, becoming the first leg 21 of the L-shaped stop bracket 2 that is connected to the back panel 1. The second leg 22 is adjacently and perpendicularly connected to the first leg 21, opposite to the back panel 1. Accordingly, the second leg 22 of the stop bracket 2 prevents the back panel 1 from warping due to externally applied forces.

In reference to FIG. 4, the present invention makes use of a user controlled system that leverages the back panel 1 against the door and doorframe to which a hinge is attached. To accomplish this, the present invention further comprises a pressing rod 6 and at least one rod-engagement mechanism 5. The pressing rod 6 is a rigid rod or cylinder that could be, but is not limited to being, a hydraulic cylinder, a pushing solenoid, a pneumatic press, or a motor driven piston. The pressing rod 6 is positioned at an angle to the back panel 1. As a result, the pressing rod 6 is able to press against the doorframe to which the hinge is attached. The pressing rod 6 is positioned at angles that include, but are not limited to, right angles or oblique angles. The at least one rod-engagement mechanism 5 is a mechanical device that is used to permit or prevent linear motion of the pressing rod 6. The at least one rod-engagement mechanism 5 and the slotted hole 4 are positioned offset from each other across the back panel 1. Consequently, the hinge and the slotted hole 4 function as the fulcrum about which the pressing rod 6 and the at least one rod-engagement mechanism 5 leverage the back panel 1. In the present invention, the pressing rod 6 is operatively interfaced with the at least one rod-engagement mechanism 5, wherein the linear motion between the pressing rod 6 and the at least one rod-engagement mechanism 5 is used to leverage the back panel 1. Accordingly, the pressing rod 6 and the at least one rod-engagement mechanism 5 work in concert to press the back panel 1 against the door, which prevents the present invention from becoming dislodged from the hinge.

Referencing FIG. 4, the pressing rod 6 is preferably a threaded bolt. Additionally, each of the at least one rod-engagement mechanisms 5 is a female-threaded hole. The threaded bolt is engaged to the female-threaded hole so that the axial rotation of the threaded bolt linearly moves the threaded bolt through the female-threaded hole. This linear motion is used to extend the threaded bolt toward the doorframe and apply the requisite force to leverage the back panel 1.

One configuration of the present invention further comprises a knob 8 that enables a user to easily rotate the pressing rod 6, which is illustrated in FIG. 4. To that end, the knob 8 is concentrically aligned to the pressing rod 6. As a result, the knob 8 shares a rotational axis with the pressing rod 6. Additionally, the knob 8 is an ergonomically shaped handle that is terminally fixed to the pressing rod 6. Consequently, actuating the knob 8 causes the pressing rod 6 to move through the at least one rod-engagement mechanism 5. The knob 8 and the back panel 1 are offset from each other along the pressing rod 6 so that actuating the knob 8 enables full length of the pressing rod 6 to travel through the back panel 1.

Figure 5:
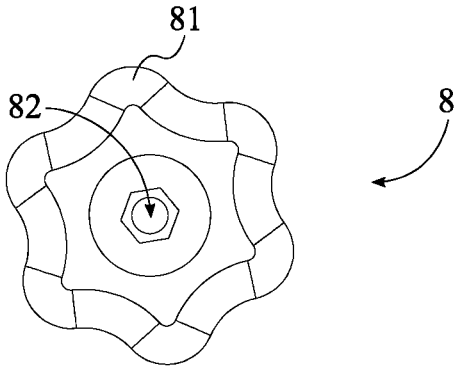
FIG. 5 is a top view of the knob.
Figure 6:
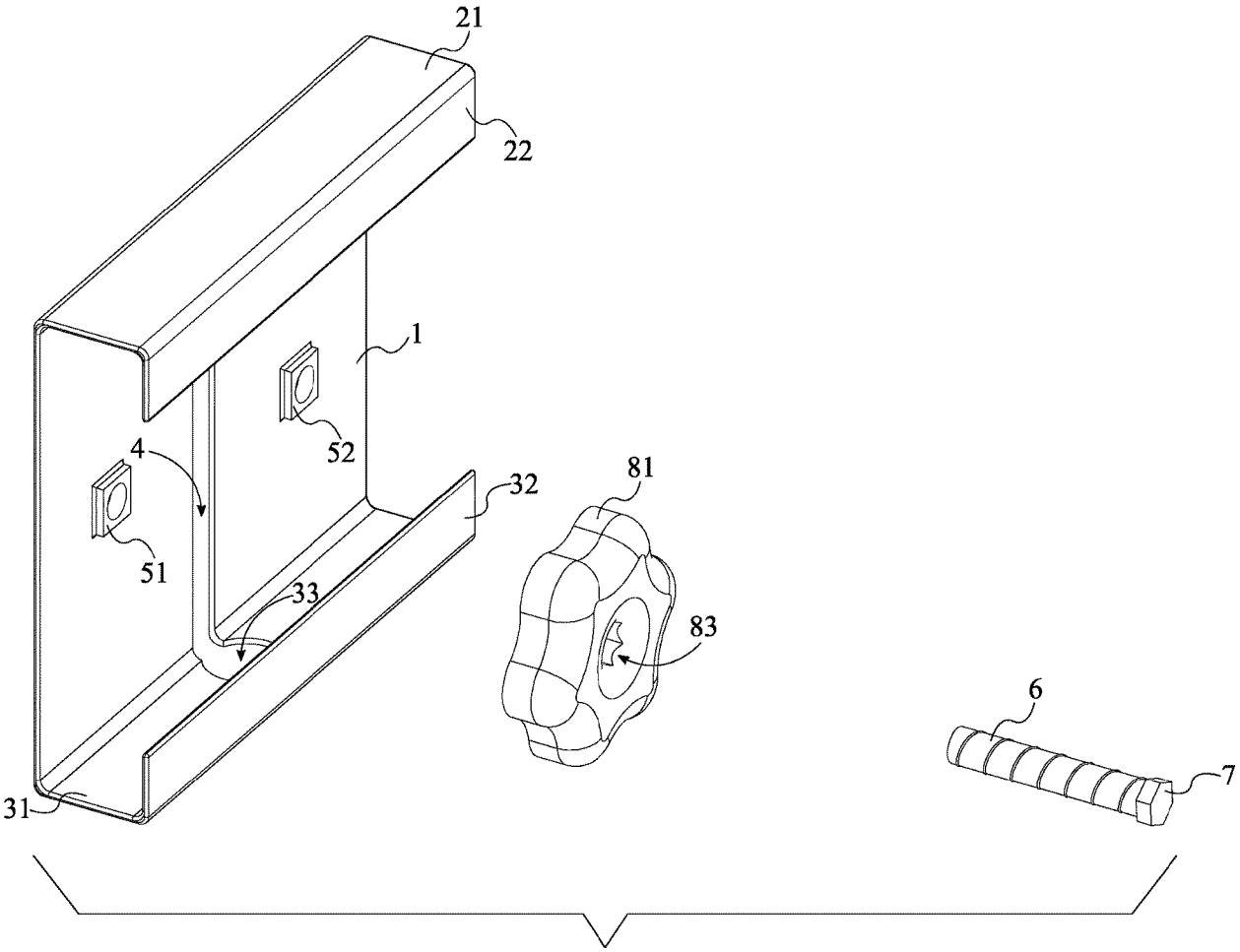
FIG. 6 is an exploded perspective view of a first alternative embodiment of the present invention, wherein the first alternative embodiment includes two rod-engagement mechanisms.

In another configuration of the present invention, the knob 8 is an ergonomically designed handle that comprises a knob body 81, a rod hole 82, and a head-receiving receptacle 83, which is illustrated in FIGS. 5 and 6. The head 7 is a multifaceted rigid body that is concentrically aligned to the pressing rod 6. As a result, the head 7 and the pressing rod 6 share a rotational axis. The head 7 is terminally fixed to the pressing rod 6. Consequently, rotation or movement of the head 7 is transferred to the pressing rod 6. The head 7 and the back panel 1 are offset from each other along the pressing rod 6. Accordingly, the movement of the pressing rod 6 through the back panel 1 is restricted by the head 7. The knob body 81 is a rigid member that forms the structural foundation of the knob 8. The head-receiving receptacle 83 traversing into the knob body 81 so that the head 7 may be inserted into the knob body 81. The rod hole 82 traversing out of the knob body 81 from the head-receiving receptacle 83. As a result, the pressing rod 6 is able to slide through the rod hole 82 and pass through the knob body 81. The rod hole 82 is concentrically aligned with the head-receiving receptacle 83 so that the head 7 of the pressing rod 6 is able to slide into the head-receiving receptacle 83. The head-receiving receptacle 83 is engaged by the head 7. Accordingly, rotation or movement of the knob 8 is transferred through the head 7 and into the pressing rod 6. This configuration enables the head-receiving receptacle 83 to be disengaged from the head 7. Once disengaged, the knob body 81 is able to slide along the pressing rod 6. Additionally, the disengaged knob 8 is prevented from actuating the head 7.

Figure 3:
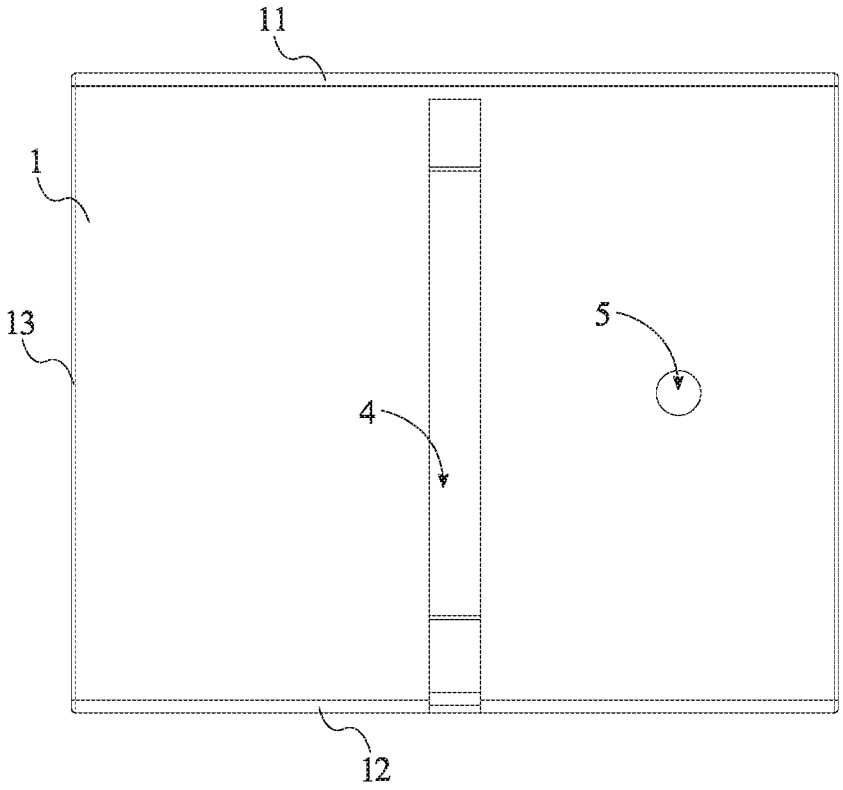
FIG. 3 is a rear view of the present invention.

Referencing FIG. 1 and FIG. 3, first panel edge 11 and the second panel edge 12 are positioned parallel to each other so that the stop bracket 2 and the keyhole bracket 3 are placed in positions which facilitate preventing a door from being opened. Additionally, the slotted hole 4 is positioned perpendicular to the first panel edge 11 and the second panel edge 12. As a result, the stop bracket 2 and the keyhole bracket 3 provide the optimal support to prevent the back panel 1 from bending or becoming warped.

In reference to FIG. 3, the present invention is designed with a filleted third panel edge 13. The filleted third panel edge 13 is positioned between the first panel edge 11 and the second panel edge 12 along the back panel 1. Thus, the filleted third panel edge 13 forms a filleted boundary for one side of the back panel 1. The slotted hole 4 is positioned in between the filleted third panel edge 13 and the at least one rod-engagement mechanism 5. As a result, the filleted third panel edge 13 does not damage the door to which it is attached.

In reference to FIG. 6, in a first alternative embodiment, the at least one rod-engagement mechanism 5 comprises a first mechanism 51 and a second mechanism 52. The slotted hole 4 is positioned in between the first mechanism 51 and the second mechanism 52. Thus, the first mechanism 51 and the second mechanism 52 enable the pressing rod 6 to leverage the back panel 1 against doors which have hinges on either the left or right side.

Figure 7:
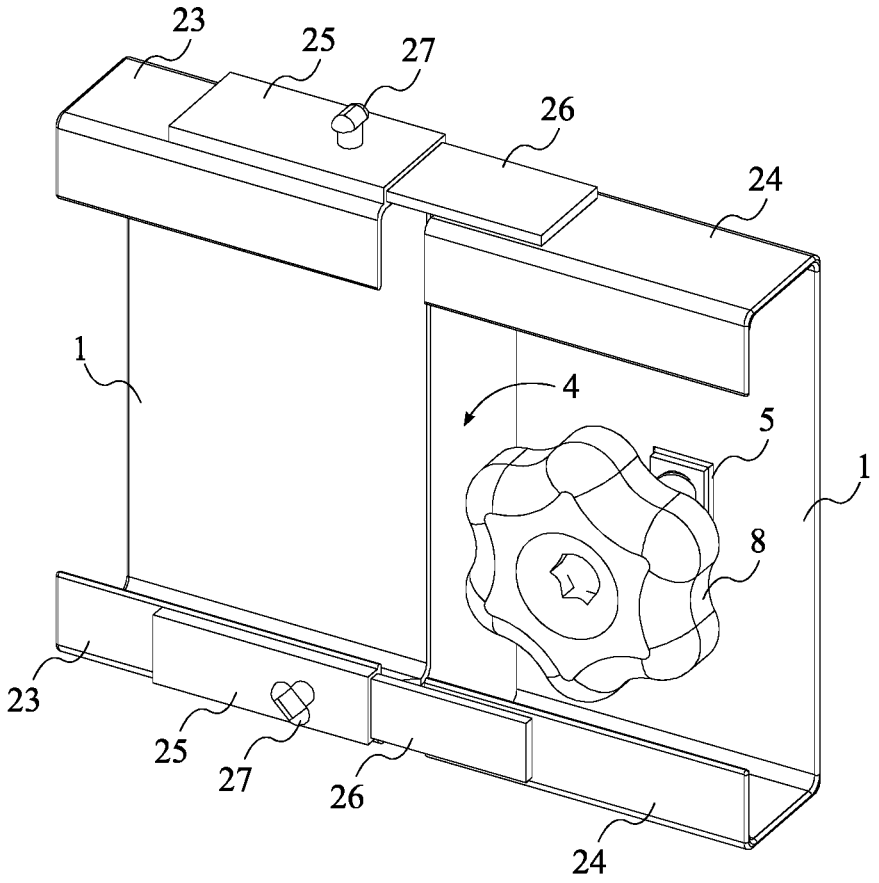
FIG. 7 is a perspective view of a second alternative embodiment of the present invention, wherein the length of the present invention can be telescopically adjusted in the second alternative embodiment.

Referencing FIG. 2 and FIG. 7, in a second alternative embodiment of the present invention, the stop bracket 2 and the keyhole bracket 3 form adjustable clamping mechanisms that are used to affix the back panel 1 to hinges of varying shape and size. In this embodiment, the stop bracket 2 and the keyhole bracket 3 each further comprise a first beam 23, a second beam 24, a slide-receiving receptacle 25, a slide rail 26, and a rail lock 27. The first beam 23 and the second beam 24 are rigid beams that mechanically support the clamping mechanism formed by the back panel 1, the stop bracket 2, and the keyhole bracket 3. The second beam 24 is positioned offset from the first beam 23. Consequently, the first beam 23 and the second beam 24 are able to clamp onto the lateral surface of a door hinge. The slotted hole 4 is delineated in between the first beam 23 and the second beam 24. Accordingly, the back panel 1 is split into two halves so that the first beam 23 and the second beam 24 can be moved closer together or farther apart. The slide-receiving receptacle 25 is adjacently connected to the second beam 24 so that the slide-receiving receptacle 25 is held in a fixed position relative to the first beam 23. Similarly, the slide rail 26 is adjacently connected to the second beam 24. As a result, the slide rail 26 is held in a fixed position relative to the second beam 24. The slide rail 26 is sleeved by the slide-receiving receptacle 25. Consequently, the slide-receiving receptacle 25 slides along the slide rail 26. The rail lock 27 is a locking mechanism that is integrated into the slide-receiving receptacle 25, wherein the rail lock is used to lock a linear position of the first beam 23 along the second beam 24. Accordingly, the rail lock 27 prevents movement of the slide rail 26 while engaged.

Although the invention has been explained in relation to its preferred embodiment, it is to be understood that many other possible modifications and variations can be made without departing from the spirit and scope of the invention as hereinafter claimed.

What is claimed is:

1. A detent for inhibiting motion of a door hinge comprising:

a back panel;

a stop bracket;

a slotted hole;

the back panel comprising a first panel edge and a second panel edge;

the first panel edge and the second panel edge being positioned opposite to each other across the back panel;

the stop bracket being adjacently connected along the first panel edge;

the slotted hole traversing normal to and through the back panel;

the slotted hole traversing into the back panel from the second panel edge;

a keyhole bracket, a keyhole slot;

the keyhole bracket being adjacently connected along the second panel edge; and the keyhole slot traversing through the keyhole bracket and into the slotted hole.

2. The detent as claimed in claim 1 wherein:

the keyhole bracket comprising a keyhole leg and a bracing leg;

the keyhole leg being adjacently and perpendicularly connected to the back panel;

the bracing leg being adjacently and perpendicularly connected to the keyhole leg, opposite to the back panel; and the keyhole slot traversing normal to and through the keyhole leg.

3. The detent as claimed in claim 1 wherein:

the stop bracket and the keyhole bracket each further comprise a first beam, a second beam, a slide-receiving receptacle, a slide rail, and a rail lock;

the second beam being positioned offset from the first beam;

the slotted hole being delineated in between the first beam and the second beam;

the slide-receiving receptacle being adjacently connected to the first beam;

the slide rail being adjacently connected to the second beam;

the slide rail being sleeved by the slide-receiving receptacle; and the rail lock being mechanically integrated into the slide-receiving receptacle, wherein the rail lock is used to lock a linear position of the first beam along the second beam.

4. The detent as claimed in claim 1 wherein:

the stop bracket comprising a first leg and a second leg;

the first leg being adjacently and perpendicularly connected to the back panel; and the second leg being adjacently and perpendicularly connected to the first leg, opposite to the back panel.

5. The detent as claimed in claim 1 further comprising:

a pressing rod;

at least one rod-engagement mechanism;

the pressing rod being positioned at an angle to the back panel;

the at least one rod-engagement mechanism and the slotted hole being positioned offset from each other across the back panel; and the pressing rod being operatively interfaced with the at least one rod-engagement mechanism, wherein linear motion between the pressing rod and the at least one rod-engagement mechanism is used to leverage the back panel.

6. The detent as claimed in claim 5 wherein:

the at least one rod-engagement mechanism comprising a first mechanism and a second mechanism; and the slotted hole being positioned in between the first mechanism and the second mechanism.

7. The detent as claimed in claim 5 wherein the pressing rod being a threaded bolt;

the at least one rod-engagement mechanism being a female-threaded hole; and the threaded bolt being engaged to the female-threaded hole.

8. The detent as claimed in claim 5 further comprising:

a knob;

the knob being concentrically aligned to the pressing rod;

the knob being terminally fixed to the pressing rod; and the knob and the back panel being offset from each other along the pressing rod.

9. The detent as claimed in claim 5 further comprising:

a knob;

the pressing rod comprising a head and a body;

the knob comprising a knob body, a head-receiving receptacle, and a rod hole;

the head being concentrically aligned to the body of the pressing rod;

the head being terminally fixed to the body of the pressing rod;

the head and the back panel being offset from each other along the pressing rod;

the head-receiving receptacle traversing into the knob body;

the rod hole traversing out of the knob body from the head-receiving receptacle;

the rod hole being concentrically aligned with the head-receiving receptacle; and the head-receiving receptacle being engaged by the head.

10. The detent as claimed in claim 5 further comprising:

a filleted third panel edge;

the filleted third panel edge being positioned between the first panel edge and the second panel edge along the back panel; and the slotted hole being positioned between the filleted third panel edge and the at least one rod-engagement mechanism.

11. The detent as claimed in claim 1 wherein:

the first panel edge and the second panel edge being positioned parallel to each other; and the slotted hole being positioned perpendicular to the first panel edge and the second panel edge.

12. A detent for inhibiting motion of a door hinge comprising:

a back panel;

a stop bracket;

a slotted hole;

a keyhole bracket;

a keyhole slot;

a pressing rod;

an at least one rod-engagement mechanism;

the back panel comprising a first panel edge and a second panel edge;

the first panel edge and the second panel edge being positioned opposite to each other across the back panel;

the first panel edge and the second panel edge being positioned parallel to each other;

the stop bracket being adjacently connected along the first panel edge;

the slotted hole traversing normal to and through the back panel;

the slotted hole traversing into the back panel from the second panel edge;

the slotted hole being positioned perpendicular to the first panel edge and the second panel edge;

the keyhole bracket being adjacently connected along the second panel edge;

the keyhole slot traversing through the keyhole bracket and into the slotted hole;

the pressing rod being positioned at an angle to the back panel;

the at least one rod-engagement mechanism and the slotted hole being positioned offset from each other across the back panel; and the pressing rod being operatively interfaced with the at least one rod-engagement mechanism, wherein linear motion between the pressing rod and the at least one rod-engagement mechanism is used to leverage the back panel.

13. The detent as claimed in claim 12 wherein:

the keyhole bracket comprising a keyhole leg and a bracing leg;

the stop bracket further comprising a first leg and a second leg;

the keyhole leg being adjacently and perpendicularly connected to the back panel;

the bracing leg being adjacently and perpendicularly connected to the keyhole leg, opposite to the back panel;

the keyhole slot traversing normal to and through the keyhole leg;

the first leg being adjacently and perpendicularly connected to the back panel; and the second leg being adjacently and perpendicularly connected to the first leg, opposite to the back panel.

14. The detent as claimed in claim 12 wherein:

the stop bracket and the keyhole bracket each further comprise a first beam, a second beam, a slide-receiving receptacle, a slide rail, and a rail lock;

the second beam being positioned offset from the first beam;

the slotted hole being delineated in between the first beam and the second beam;

the slide-receiving receptacle being adjacently connected to the first beam;

the slide rail being adjacently connected to the second beam;

the slide rail being sleeved by the slide-receiving receptacle; and the rail lock being mechanically integrated into the slide-receiving receptacle, wherein the rail lock is used to lock a linear position of the first beam along the second beam.

15. The detent as claimed in claim 12 wherein:

the at least one rod-engagement mechanism comprising a first mechanism and a second mechanism; and the slotted hole being positioned in between the first mechanism and the second mechanism.

16. The detent as claimed in claim 12 wherein the pressing rod being a threaded bolt;

the at least one rod-engagement mechanism being a female-threaded hole; and the threaded bolt being engaged to the female-threaded hole.

17. The detent as claimed in claim 12 further comprising:

a knob;

the knob being concentrically aligned to the pressing rod;

the knob being terminally fixed to the pressing rod; and the knob and the back panel being offset from each other along the pressing rod.

18. The detent as claimed in claim 12 further comprising:

a knob;

the pressing rod comprising a head and a body;

the knob comprising a knob body, a head-receiving receptacle, and a rod hole;

the head being concentrically aligned to the body of the pressing rod;

the head being terminally fixed to the body of the pressing rod;

the head and the back panel being offset from each other along the pressing rod;

the head-receiving receptacle traversing into the knob body;

the rod hole traversing out of the knob body from the head-receiving receptacle;

the rod hole being concentrically aligned with the head-receiving receptacle; and the head-receiving receptacle being engaged by the head.

19. The detent as claimed in claim 12 further comprising:

a filleted third panel edge;

the filleted third panel edge being positioned between the first panel edge and the second panel edge along the back panel; and the slotted hole being positioned between filleted third panel edge and the at least one rod-engagement mechanism.

* * * * *